US005755599A

United States Patent [19]

Hotea

[11] Patent Number: 5,755,599

[45] Date of Patent: May 26, 1998

[54] ELECTRICAL CONTACT

[75] Inventor: Gheorghe Hotea, Griesheim, Germany

[73] Assignee: The Whitaker Corporation, Wilmington, Del.

[21] Appl. No.: 704,533

[22] PCT Filed: Mar. 7, 1995

[86] PCT No.: PCT/IB95/00140

§ 371 Date: Dec. 2, 1996

§ 102(e) Date: Dec. 2, 1996

[87] PCT Pub. No.: WO95/25362

PCT Pub. Date: Sep. 21, 1995

[30] Foreign Application Priority Data

Mar. 17, 1994 [GB] United Kingdom ..... 9405303

[51] Int. Cl.[6] ..... H01R 4/48

[52] U.S. Cl. ..... 439/745; 439/851

[58] Field of Search ..... 439/839, 842, 439/843, 845, 846, 847, 851, 852, 856, 857, 746, 745, 744, 747

[56] References Cited

U.S. PATENT DOCUMENTS

| | | | |
|---|---|---|---|
| 4,666,227 | 5/1987 | Galizia et al. | 439/851 |
| 4,900,271 | 2/1990 | Colleran et al. | 439/856 |
| 4,907,990 | 3/1990 | Bertho et al. | 439/851 |
| 5,007,865 | 4/1991 | Jakobeit | 439/839 |
| 5,362,262 | 11/1994 | Hotea | 439/839 |
| 5,624,283 | 4/1997 | Hotea | 439/745 |

FOREIGN PATENT DOCUMENTS

| | | | |
|---|---|---|---|
| 1952925 | 6/1971 | Germany | 439/744 |
| 3424072 | 1/1986 | Germany | 439/857 |
| 60 7014 | 3/1985 | Japan | H01R 13/11 |

*Primary Examiner*—Gary F. Paumen
*Assistant Examiner*—Tho Dac Ta

[57] ABSTRACT

A contact is shown comprised of an inner spring and an outer assist spring where the front contact section is longitudinally moveable within the outer assist spring. The front contact section includes contact arms where side spring sections are constricted inwardly by way of transition sections at, thereby forming a compact forward contact section. A contact having a contact section, a conductor engaging section and a central section therebetween where the contact section includes opposing contact arms with side arms therealong both arms being joined to the central section where the central section has a width greater then the width of the contact section, where the central section may be made resilient for float between the contact section and conductor engaging section, an outer assist spring may be provided to prevent overstress, or include a locking lance cantilevered from a band section defined by a slit therein.

15 Claims, 3 Drawing Sheets

ELECTRICAL CONTACT

BACKGROUND OF THE INVENTION

1. Field of the Invention

The subject of the invention relates to an improved electrical contact, and more particularly to an electrical contact that may be received in existing contact cavities and, in some cases, may be adapted for use in high vibration atmospheres.

2. Description of the Prior Art

Many sensors are now used in applications where they are subject to high vibrations, such as in automotive sensing applications, the vibrations may lead to fretting corrosion, and, over the life time of the connector, cause a failure in the automotive sensing circuit. While it is always desirable to provide contacts for such use in high vibration atmospheres, it is also a requirement to maintain these contacts on a relatively close centreline. In fact it is desirable to keep these contacts on the same centreline and compatible with existing connector housings which are already available. This is advantageous to the end user, who has already established their packaging requirements within the automobile and, possibly, already established the size and layout of the sensor contacts. Some of these connector systems are somewhat standardized within the industry, with the housings varying only slightly and in the number of cavities in each housing.

One such connector family is known as applicant's Junior Power Timer family, which is a highly recognized connector system presently used in automotive connection systems. The connector housing includes a front face adapted to receive a tab-type terminal, and a socket terminal that is situated within the housing to receive the tab. The socket terminal includes two contact arms in opposing relation and extending forwardly to a constricted portion for receiving the tab therebetween and exerting a axially extending ribs are positioned in each corner of the housing on the inside of the contact passageway.

A problem exists in that it is desirable to provide enhanced functions for an electrical contact, for example sensor applications described above. These enhancements may occur in the central section of a contact. However, in order to assure the contact remains usable with existing interfaces, it is desirable that the contact or socket section of the contact be receivable in an existing contact passageway, even in cases when the enhancements result in a central section of the contact taking on a configuration larger than the contact passageway. Furthermore, in order to provide a contact that may be adapted to perform the sensor function, it is desirable for the front contact section to be configured such that the section can float relative the wire engaging section.

EP-A-0 433 610 discloses an electrical contact having a central section, a front contact section and a conductor engaging section where the front contact section includes a pair of opposed contact arms configured for receiving a tab therebetween. The contact arms have a width less than the width of the side of the central section from which they originate. An outer box is provided about the central section 6 and a tongue member extends over the contact arms to provide support thereto. The outer box being tightly affixed to the contact along the central section.

It is an object of this invention then to provide a new socket contact which can be used with existing connector housings.

It is a another object of this invention to provide an improved electrical socket contact which can be used in high vibration atmospheres.

It is yet another object of this invention to provide an improved electrical socket contact that has a short stiff locking lance.

At least one aspect of the invention is accomplished by providing an electrical contact having a central section, a front contact section and a wire section, where the front contact section includes a pair of opposed contact arms that extend from the central section for receiving a tab therebetween, a transversely disposed arm extends from the central section along at least one side of each of the opposed contact arms and is joined therewith at towards an extreme end of the contact arm, where the width of the contact along the contact section is less than the width of the central section.

At least one aspect of the invention is accomplished by providing an electrical contact having a central section, a front contact section and a wire section, where the front contact section includes a pair of opposed contact arms that extend from the central section for receiving a tab therebetween, wherein the central section includes a flexible portion enabling the front contact section to move relative the wire section.

At least one aspect of the invention is accomplished by providing an electrical contact having a central section, a front contact section and a wire section, the central section includes a wall from which a locking lance is cantilevered outward therefrom, the wall further section, a front contact section and a wire section, the central section includes a wall from which a locking lance is cantilevered outward therefrom, the wall further including a slit to define a band section from which the lance extends.

It is an advantage of one aspect of the invention that the contact will fit into a previously established connector contact cavity. It is an advantage of another aspect of the invention that the front contact portion may float relative the wire section so that fretting corrosion is prevented. It is another advantage that the slit provides a band section that provides additional resilience so that a stiff locking lance has the resiliency to be deflected for fitting into a contact cavity and have the resilience necessary to resiliently return to a position that would interfere with a shoulder along the cavity to prevent withdrawal therefrom. It is another advantage that the aforementioned features en mass or singularly may be incorporated into a single piece contact or a multi-piece contact, are easy and economical to manufacture, and may include other known advantageous features.

DETAILED DESCRIPTION OF THE PREFERRED EMBODIMENT

Figure 1:
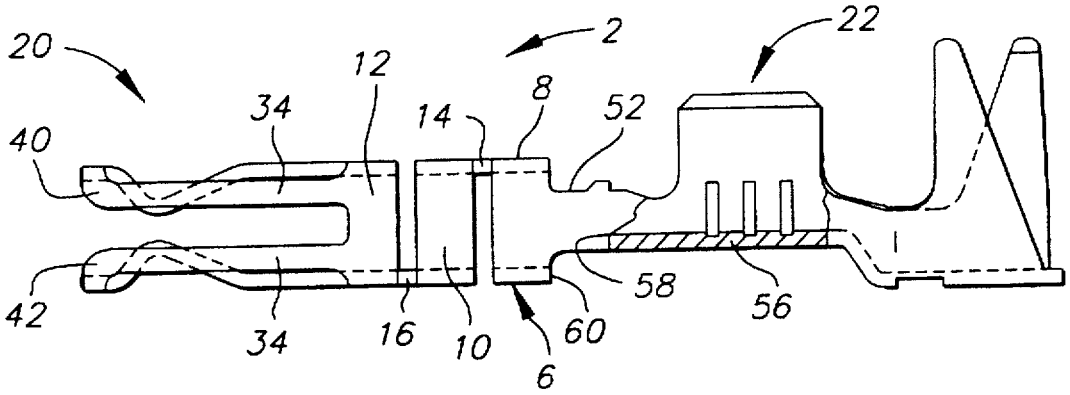
FIG. 1 is a side view of the inner contact portion.
Figure 2:
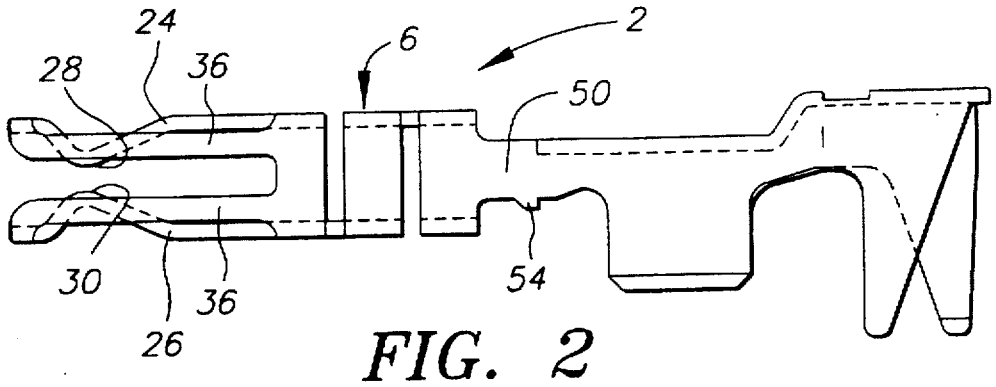
FIG. 2 a plan view of the opposite side.
Figure 3:
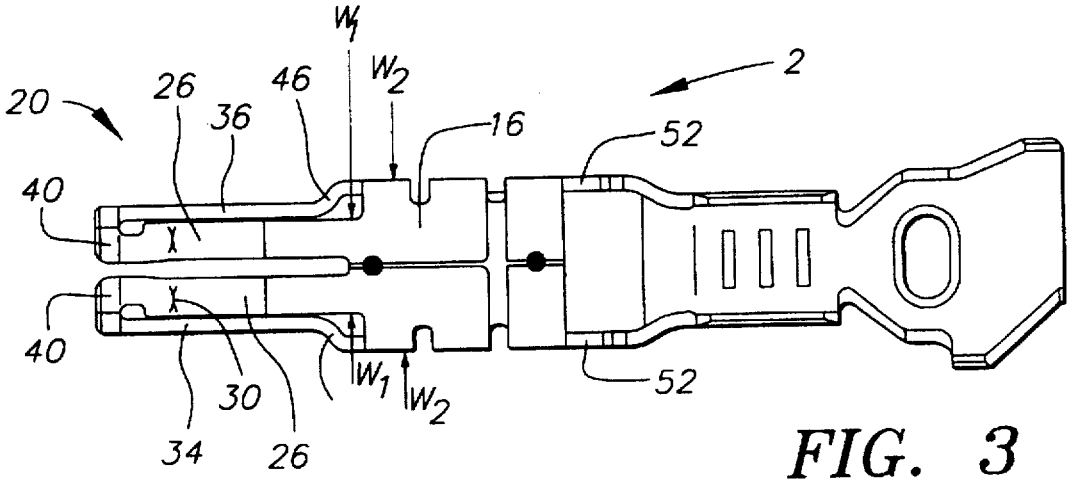
FIG. 3 is a top view of the inner socket contact.
Figure 4:
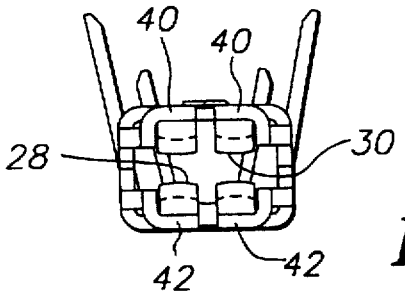
FIG. 4 is a front view of the socket contact of any of FIGS. 1–3.

An anti-fretting version of the invention will now be described with reference first to FIGS. 1–4 where an inner contact is shown generally at 2. The inner contact includes a central section 6 with individual box shapes 8,10 and 12 that are interconnected by web members 14 and 16, thereby allowing longitudinal movement of the front contact section 20 relative to the wire crimp section 22. As shown best in FIGS. 3 and 4, two contact arms 24 extend forwardly from the box member 12 while two contact arms 26 extend forwardly from a lower portion of the box member 12 and are opposed to contact arms 24. Contact arms 24 and 26 are constricted at 28 and 30, thereby forming a receiving section for a tab of a mating contact (not shown). Arms 34 and 36, as shown in FIG. 1 and 2 respectively, also extend from the box member 12 and extend forwardly to L-shaped portions 40 and 42 where they are interconnected with the respective contact arms 24,26, as best shown in FIG. 4.

To provide a compact contact section 20, the contact arms 24 and 26 have a width W1, whereas the box member 12 has a width W2. The arms 34 and 36 are folded about the L-shaped sections 40 to lie adjacent to the side edges of the contact arms 26 in a transverse manner such that the contact arms are supported by a beam having a relevant dimension greater than the thickness of the material. The front contact section presents the narrowed width by necking the arms inward and being narrowed through transition zones 44, 46. This presents a nose that will fit into an existing cavity with a body substantial enough to incorporate the necessary features such as box closure, locking lances and secondary locking shoulders.

Finally, the side walls 50 which extend rearwardly from the section 8 have upper edges at 52 having locking barbs at 54 as will be described in greater detail herein. Furthermore, the base section 56 includes an opening at 58 thereby forming a rearwardly facing edge 60 from the section 8, also which will be described in greater detail herein.

Figure 5:
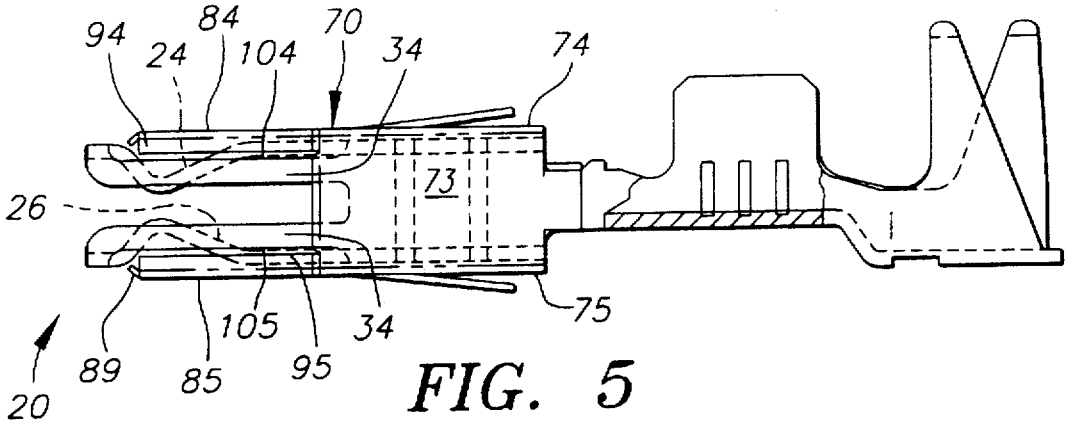
FIG. 5 is a view similar to that of FIG. 1 together with an outer protective spring.

With respect now to FIG. 5, an outer assist spring is shown at 70 including side walls 72,73; a top wall 74; and a lower wall 75. In addition to the other functions described below, the outer assist spring 70 may carry a set of locking lances to retain the contact within a terminal cavity of a connector housing (not shown). A rear portion of the assist spring 70 includes crimp sections 78 which are crimped around the upper edge 52 forward of the barb sections 54 to maintain the assist spring in secure position on the inner contact 2. It should be appreciated that the outer assist spring 70 is clinched to the rear portion of the inner contact 2 which is fixed, thereby allowing the forward contact section 20 to be longitudinally moveable within the assist spring 70 relative the wire section 22.

Figure 6:
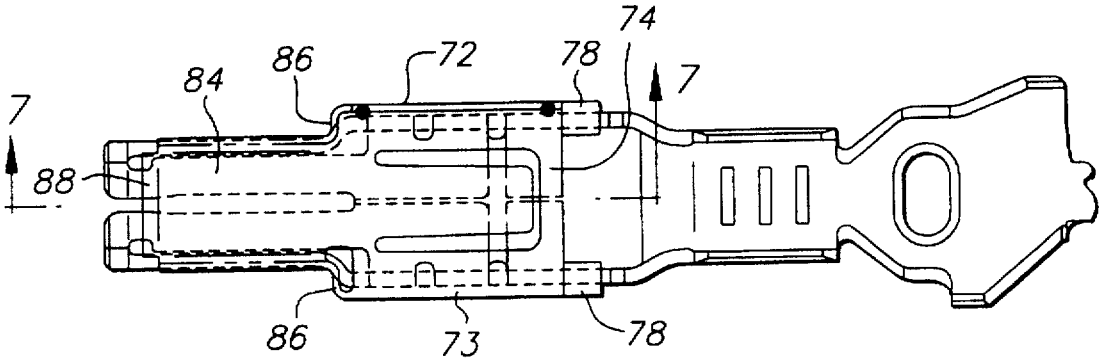
FIG. 6 is a view similar to that of FIG. 3 with the outer protective spring.
Figure 7:
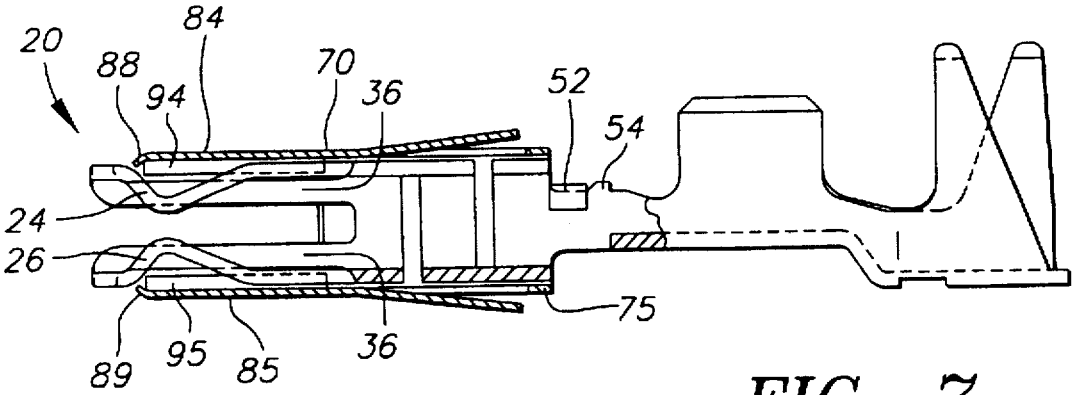
FIG. 7 is a cross-sectional view through lines 7—7 of FIG. 6.
Figure 8:
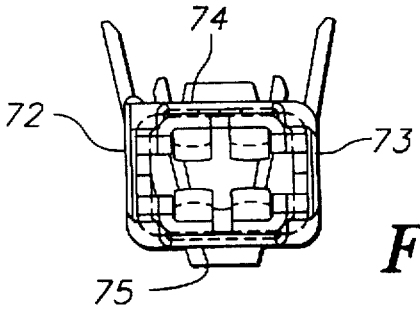
FIG. 8 is a front end view of the contact viewed in any of FIGS. 5–7.

Forwardly extending arms 84 and 85 extend from walls 74 and 75 respectively. The arms 84 and 85 do not contact the contact arms 24 and 26, but rather are spaced apart to allow the longitudinal movement of the forward spring member 20. It should be appreciated from FIG. 6 however, that the arms 84 and 85 are contoured to overly, at substantially the same width as, the contact arms 24 and 26. This is accomplished by the outer assist spring 70 including a transition section at 86, thereby forming contoured spring arms 84 and 84. It should be appreciated that each outer edge of the spring arms 84, 85 include folded-over tab sections 94 and 95 are spaced from respective edges 104 and 105 of the spring arms 34. As shown in FIG. 7, the opposite side of the spring arms 84 and 85 also include tab members 94 and 95. The forward free ends of the arms 84 and 85 include inwardly directed sections at 88 and 89 spaced from the contact spring arms 24 and 26 respectively.

Advantageously then, the transition sections 44 and 46 of the inner contact 2 provide a compact inner front contact section at 20 having a substantially square cross section as shown in FIG. 4. Even though the spring arms 24 and 26 are narrowed to a distance W1, the contact arms are rigidified through the arms 34 and 36 which are integrally interconnected through the L-shaped free end portions at 40. Furthermore, the contact member 2 includes longitudinally moveable sections 8, 10 and 12 thereby allowing the section 8 to be maintained in a fixed position while the contact section 20 can move forwardly and rearwardly relative thereto. The front contact section 20 is moveable within the assist spring member 70, and the movement of the contact spring is guarded by the safety features provided by the outer assist spring. For example the tab members 94 and 95 prevent over-stressing of the contact arms 24 and 26, such that if the arms 24 and 26 expand too far outwardly, the edges 104 and 105 of the side arm springs 34 will contact the tab portions 94 and 95 preventing over-stressing thereof. Furthermore, the front end section 88 and 89 prevent over-stressing of the forward contact section 20 along the longitudinal axis by preventing displacement too far inwardly.

Figure 9:
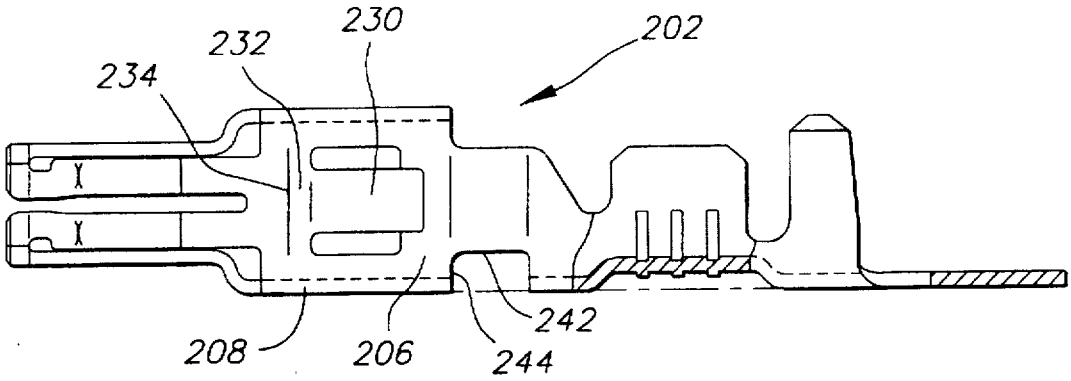
FIGS. 9–11 are views of an alternate embodiment.
Figure 10:
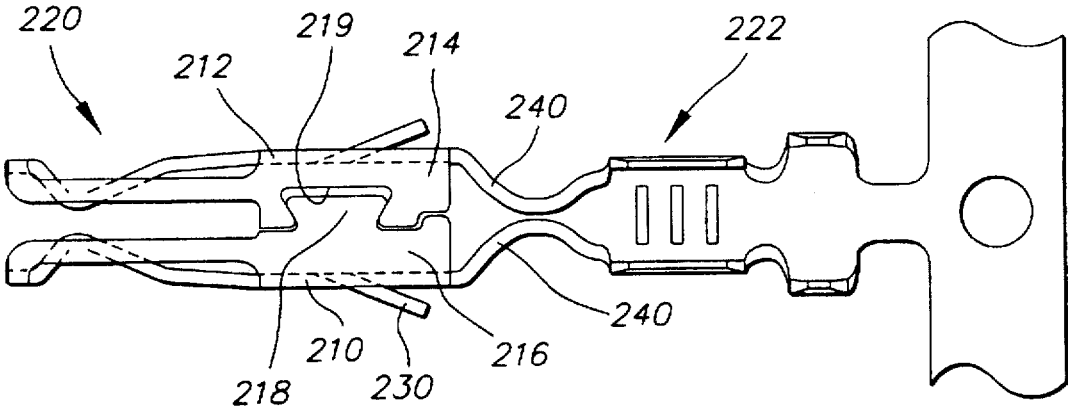
Figure 11:
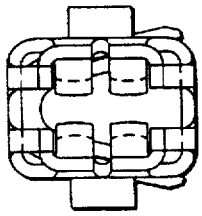

With respect now to FIGS. 9–11, an alternate embodiment of a contact according to at least one aspect of the invention is shown at 202. The contact 202 has a central section 206 comprised of a lower wall 208 sidewalls 210 and 212 and top cover halves 214 and 216. The cover halves include complementary dovetail tab and slot 218, 219 features that join the contact together along the longitudinal axis. It is envisioned that other know techniques may be advantageous.

The front contact section 220 of this embodiment is virtually identical to the front contact section 20 of the embodiment of FIGS. 1–8, thereby enabling this contact to recognize the aforegoing advantages. However, the contact section 220 of this contact is not longitudinally moveable relative to the wire crimp section 222.

As opposed to the afore-described contact section 2, which had the locking lances integral with the outer assist spring 70 (FIGS. 5–7), in the one-piece contact of 202, the locking lances 230 are integral with the side walls 210 and 212 of the central section 206. The locking lances 230 are formed such that they extend from a band section 232 in a cantilevered manner. The band section 232 is defined by a sheared line segment at 234 that is spaced from the location from which the locking lance 230 is cantilevered, as best seen in FIG. 9. Note the sheared line segment may actually be a series of segments, interconnected if desired to form a path other than straight, such as a curve, a chevron, or a louver-like structure having multiple short slits to define the overall segment. The band section 232 enables a short stiff locking lance 230 to be incorporated into a contact where it would normally not be possible due to the required length of the lance.

Typically, a locking lance must be sufficiently long to assure that for the material chosen the lance will undergo resilient and not plastic deformation as the contact is inserted into the connector housing to assure the locking lance after being deflected will be able return to a position for engaging the backside of a shoulder after being passed thereby. By forming the band section 232, which has some flexibility, the locking lance 230 is torsionally moveable about the band portion 232. Furthermore, the additional flexibility of the band section 232 aids in the dampening of relative vibration between the mating contacts. Note, construction of this type may also be incorporated into contacts of any configuration and may be incorporated into other parts of a contact which carry the locking lance, such as an outer back-up spring. Therefore, the term central section of the contact means that part of the contact which carries the locking lance and this invention should not be limited by the embodiment depicted.

Intermediate the base section 206 and the wire crimp section 222, the contact is constricted along arms 240 and includes a cutout section at 242, thereby allowing a stiff locking surface at 244. In this embodiment, the arms 240 extend approximately symmetrically from the central section forming an upper surface similar to locking surface 244.

I claim:

1. An electrical terminal comprising:

an inner terminal having a rear section for engaging a conductor;

a central section having a box-shaped body including four side walls arranged as two pairs of opposing side walls where the side walls of each pair are transverse to the side walls of the other pair, and each side wall is adjacent the side walls of the other pair the central section being connected to the rear section;

a front contact portion having four contact arms arranged as two adjacent pairs of a opposing contact arms, the contact arms arranged such that one contact arm from each pair are forward extending continuations of each one of the opposing side walls, the contact arms of each pair of contact arms extend from respective side walls of the central section then converge towards one another to define a receiving section at contact surfaces for a mating contact then diverge outward to contact arm ends; the front contact portion further including four support arms, each support arm extending from one of the side walls of the other pair of opposing side walls generally along, but separate from, a corresponding one of the contact arms to a forward end, the support arm being transverse to the contact arm, the forward end of each support arm and the forward end of the corresponding contact arm being integrally joined through an L-shaped section such that the contact arm is supported by a support beam having a width greater than the thickness of material from which the support beam is formed, the four L-shaped sections combine to define a box shaped mating contact receiving opening in communication with the receiving section, the mating tab being received in the opening; and, an outer assist spring, the outer assist spring having opposing side walls, a top wall and an opposing bottom wall wrapped around the body of the central section, the top and bottom walls corresponding to the pair of opposing side walls form which the contact arms extend and including arms extending therefrom and overlying the contact arms.

2. The electrical terminal of claim 1, wherein the arms extend along outer edges thereof through folded over sections spaced from the support arms.

3. The electrical terminal of claim 1, therein the arms of the outer assist spring include forward free ends having inwardly directed section.

4. The electrical terminal of claim 1, wherein the outer assist spring included crimp section which are crimped around the inner terminal to maintain the assist spring in a secure position on the inner terminal.

5. The electrical terminal of claim 4, wherein the outer assist spring includes a locking lance for retaining the terminal within a terminal cavity of a connector housing.

6. The electrical terminal of claim 1, wherein the body portion of the inner terminal includes individual box shapes interconnected by webs enabling relative movement of the front contact portion relative the rear section.

7. The electrical terminal of claim 6, wherein the outer assist spring is anchored to the inner terminal towards the rear section such that the front section can move therein.

8. The electrical terminal of claim 1, wherein the contact portion across the contact arms has a width less than the width of the body of the central section from which the contact arms extend.

9. The electrical terminal of claim 8, wherein the support arms include transition zones as they extend from the respective opposing side walls of the body to run generally parallel to the respective contact arms.

10. The electrical terminal of claim 1, wherein the arms of the outer assist spring are generally co-planar extensions of the top and bottom walls.

11. The electrical terminal of claim 10, wherein the ends of the two contact arms of the two pairs of contact arms that extend from the same side wall of the body are independent of one another.

12. The electrical terminal of claim 10, wherein the arms of the other assist spring include inwardly directed front sections.

13. The electrical terminal of claim 12, wherein the arms of the outer assist spring prevent over stressing of the contact arms and support arms of the inner terminals.

14. The electrical terminal comprising a central section with at least one wall with a locking lance cantilevered therefrom and the wall includes a slit spaced from where the locking lance is cantilevered to define a band section from which the lance extends;

a contact section extending from the central section for receiving a complementary terminals, the contact section including opposing contact arms that extend from the central section and support arms that also extend from the central section and are disposed along the contact arms and coupled therewith opposite the central section, where the contact section has a width less than the width of the central section; and, a conductor engaging section extending from the central section for engaging a conductor.

15. The electrical terminal of claim 14, wherein the terminal of one piece construction including a seam of opposing edges along the central section, the opposing edges including complementary profiles that are interengaged to hold the seam closed.

* * * * *